US006142741A

United States Patent [19]

Nishihata et al.

[11] Patent Number: 6,142,741

[45] Date of Patent: Nov. 7, 2000

[54] HERMETIC ELECTRIC COMPRESSOR WITH IMPROVED TEMPERATURE RESPONSIVE MOTOR CONTROL

[75] Inventors: Hideo Nishihata, Ootsu; Naomi Goto, Shiga-ken; Norio Yoshida, Moriyama, all of Japan

[73] Assignee: Matsushita Electric Industrial Co., Ltd., Osaka, Japan

[21] Appl. No.: 08/599,583

[22] Filed: Feb. 9, 1996

[30] Foreign Application Priority Data

Feb. 9, 1995 [JP] Japan ..... 7-021896

[51] Int. Cl.[7] ..... F04B 49/10

[52] U.S. Cl. ..... 417/32; 62/126; 62/228.4; 361/22; 361/24

[58] Field of Search ..... 417/32; 62/126, 62/228.4; 361/22, 24, 27; 439/95, 96, 98, 99, 620, 76.1, 556, 559, 610

[56] References Cited

U.S. PATENT DOCUMENTS

| | | | |
|---|---|---|---|
| 2,946,203 | 7/1960 | Carver | 417/32 |
| 3,877,837 | 4/1975 | Parker et al. | 417/32 |
| 3,978,382 | 8/1976 | Pfarrer et al. | 318/221 R |
| 4,250,490 | 2/1981 | Dahlke | 340/870.37 |
| 4,410,983 | 10/1983 | Cope | 371/8 |
| 4,542,324 | 9/1985 | Leuthen | 318/798 |
| 5,027,426 | 6/1991 | Chiocca, Jr. | 455/5 |
| 5,079,488 | 1/1992 | Harms et al. | 417/32 |
| 5,095,291 | 3/1992 | Staschover et al. | 333/12 |
| 5,272,476 | 12/1993 | McArthur et al. | 340/870.13 |
| 5,368,446 | 11/1994 | Rode | 417/18 |
| 5,509,786 | 4/1996 | Mizutani et al. | 417/32 |

FOREIGN PATENT DOCUMENTS

| | | | |
|---|---|---|---|
| 0029852 | 2/1987 | Japan | 417/32 |
| 0129586 | 6/1987 | Japan | 417/32 |

*Primary Examiner*—Xuan M. Thai
*Attorney, Agent, or Firm*—Pollock, Vande Sande & Amernick

[57] ABSTRACT

A hermetic electric compressor includes a motor unit having a stator coil and a compressor unit driven by the motor unit for compressing refrigerant gas. A temperature sensor is provided at the stator coil for monitoring a temperature of the stator coil. A control unit is further provided to control a rotational frequency or speed of the motor unit via the stator coil depending on the monitored temperature of the stator coil. The temperature sensor and the control unit are connected via a shielded cable or a twisted pair. The shielded cable or the twisted pair may be grounded via a capacitor. Further, a thermostat may also be provided at the stator coil and connected in series to the temperature sensor.

13 Claims, 8 Drawing Sheets

HERMETIC ELECTRIC COMPRESSOR WITH IMPROVED TEMPERATURE RESPONSIVE MOTOR CONTROL

BACKGROUND OF THE INVENTION

1. Field of the Invention

The present invention relates to a hermetic electric compressor for use, particularly, in a car air conditioner.

2. Description of the Prior Art

FIGS. 8 and 9 show a conventional hermetic electric compressor. In FIG. 8, the compressor as represented by numeral 12 includes a sealed casing 12A. The sealed casing 12A includes therein a three-phase motor unit 1, and a compressor unit 6 driven by the motor unit 1 for compressing refrigerant gas. The compressor 12 further includes a discharge pipe 4 for discharging the compressed refrigerant gas outside the sealed casing 12A for a refrigerating cycle. As shown in FIG. 9, the motor unit 1 includes a stator having a coil unit 2 with three coils. The three coils are connected to an inverter unit 21 via three-phase terminals U, V and W, respectively, for receiving alternating current of a controlled frequency. A thermostat 3 is firmly tied at a proper portion on the coil unit 2 or between the coils, using proper strings for this purpose, and is connected to a control circuit 20 of the inverter unit 21.

With this arrangement, when the compressor 12 is overloaded so that a temperature of the coil unit 2 increases to exceed a preset value, the thermostat 3 is operated to open the circuit. The control circuit 20 detects it and stops energization to the coil unit 2 for preventing damage of the coil unit 2 due to heat.

In another conventional hermetic electric compressor, a thermistor 5 is attached to the discharge pipe 4, instead of the thermostat 3 at the coil unit 2 in the foregoing compressor, for monitoring temperatures of the discharged gas at the discharge pipe 4, which is also shown in FIG. 8. As also shown in FIG. 9, the thermistor 5 is connected to the control circuit 20. With this arrangement, when the monitored temperature exceeds a preset value, the control circuit 20 detects it to stop energization to the coil unit 2, or alternatively, the control unit 20 detects it to lower a frequency of the alternating current fed to the coil unit 2, that is, a rotational frequency or speed of a rotor of the motor unit 19 to a preset value for preventing damage of the coil unit 2 due to heat.

However, in the foregoing conventional compressors, there have been the following problems:

When energization to the coil unit 2 is stopped by operating the thermostat 3, several minutes are necessary for the thermostat 3 to be restored to restart the operation of the compressor. Thus, if the compressor is applied to the car air conditioner, since the car air conditioner is stopped in operation for ten and several minutes, the inner surfaces of window glasses of a car may be clouded up depending on conditions of the inside air and the outside air. This may raise a serious problem to the car driving. Further, the air condition inside the car may be extremely deteriorated.

On the other hand, when energization to the coil unit 2 is stopped or a frequency of the alternating current fed to the coil unit 2 is lowered to reduce the load of the compressor by using the thermistor 5, the following problem may be encountered: During a normal operation of the compressor, the coil unit 2 is cooled by the compressed gas so that a difference in temperature between the discharged gas and the coil unit 2 is held at 5~10 degrees. On the other hand, during an overload operation of the compressor or when a compression ratio is large, a gas circulation amount is extremely reduced, and thus, the cooling of the coil unit 2 by means of the compressed gas becomes insufficient. In this case, it possible that a difference in temperature between the discharged gas and the coil unit 2 becomes more than 20 degrees. Further, since the ambient temperature around the discharge pipe 4 affects the temperature of the discharged gas at the discharge pipe 4, when the ambient temperature is quite low, a difference between the temperature of the discharged gas as monitored by the thermistor 5 and the coil temperature increases. As a result, the compressor continues to be operated even when the coil temperature actually exceeds the preset value so that the coil unit 2 is seriously damaged due to heat.

Further, since the thermostat 3 and the control circuit 20 in the former compressor and the thermistor 5 and the control circuit 20 in the latter compressor are connected via general leads, that is, general insulated wires, as shown in FIG. 8, it is possible that electrical noise caused by operation of the inverter unit 21 or the like may enter a signal line to the control circuit 20 to cause malfunction thereof.

SUMMARY OF THE INVENTION

Therefore, it is an object of the present invention to provide an improved hermetic electric compressor.

According to one aspect of the present invention, a hermetic electric compressor comprises a sealed casing; a motor unit provided in the sealed casing and having a stator coil; a compressor unit provided in the sealed casing and driven by the motor unit for compressing a refrigerant; a temperature sensor provided at the stator coil for monitoring a temperature of the stator coil; and control means, responsive to the temperature monitored by the temperature sensor, for controlling a speed of the motor unit via the stator coil, wherein the temperature sensor and the control means are connected via a shielded cable or a twisted pair at least partly.

It may be arranged that the control means lowers the speed of the motor unit to a preset value when the temperature monitored by the temperature sensor exceeds a first preset value and that the control means stops the motor unit when the temperature monitored by the temperature sensor exceeds a second preset value which is greater than the first preset value.

It may be arranged that a thermostat is further provided so as to be connected in series to the temperature sensor, that the control means lowers the speed of the motor unit to a preset value when the temperature monitored by the temperature sensor exceeds a first preset value, and that the controls means stops the motor unit when the temperature of the stator coil exceeds a second preset value so as to operate the thermostat, the second preset value being greater than the first preset value.

It may be arranged that a shield conductor of the shielded cable or one line of the twisted pair is grounded to the sealed casing via a capacitor.

It may be arranged that a connector is further provided at the sealed casing so as to have inner terminals located inside the sealed casing and outer terminals located outside the sealed casing, that the temperature sensor is connected to the inner terminals and the control means is connected to the outer terminals, and that the temperature sensor and the inner terminals are connected via the shielded cable or the twisted pair.

It may be arranged that a connector is further provided at the sealed casing so as to have inner terminals located inside the sealed casing and outer terminals located outside the sealed casing, that the temperature sensor is connected to the inner terminals and the control means is connected to the outer terminals, and that the control means and the outer terminals are connected via the shielded cable or the twisted pair.

It may be arranged that a shield conductor of the shielded cable or one line of the twisted pair is grounded to the sealed casing at a portion other than the connector.

It may be arranged that the shield conductor of the shielded cable or the one line of the twisted pair is grounded to the sealed casing via a capacitor.

BRIEF DESCRIPTION OF THE DRAWINGS

The present invention will be understood more fully from the detailed description given hereinbelow, taken in conjunction with the accompanying drawings.

In the drawings.

DESCRIPTION OF THE PREFERRED EMBODIMENT

Now, preferred embodiments of the present invention will be described hereinbelow with reference to the accompanying drawings. Throughout the figures including the figures showing the prior art, the same signs or symbols represent the same or like components.

Figure 4:
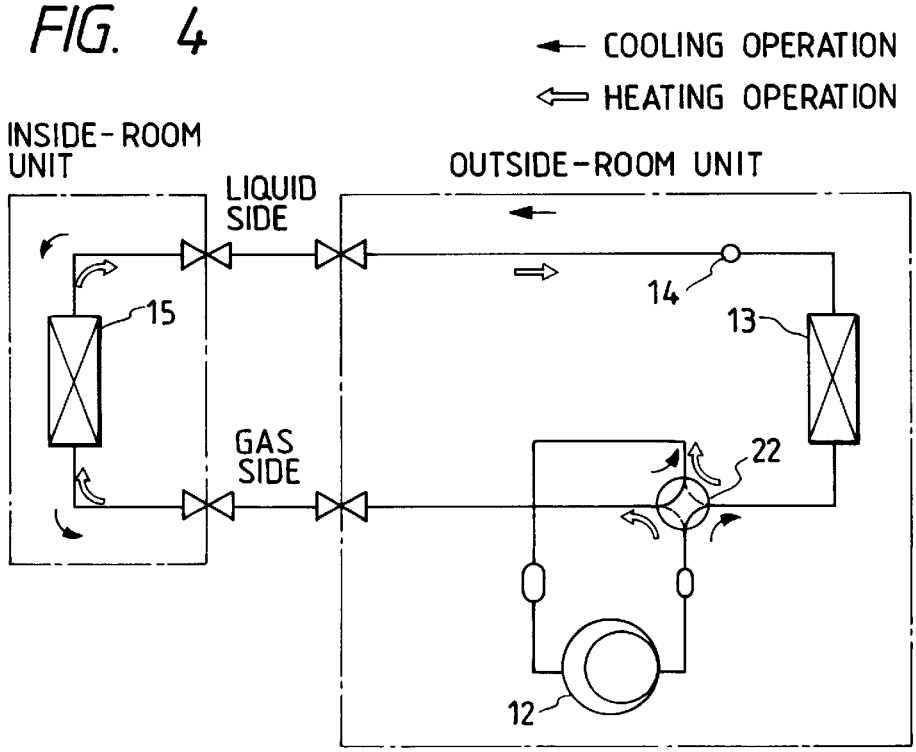
FIG. 4 is a diagram showing a refrigerating cycle of a general heat pump air conditioner.

Prior to description of the preferred embodiments of the present invention, a refrigerating cycle of a general heat pump air conditioner to which a hermetic electric compressor of each of the later-described preferred embodiments is applicable will be first explained briefly with reference to FIG. 4. As shown by solid arrows, in case of a cooling operation of the heat pump, refrigerant gas is adiabatically compressed to a high-temperature/high-pressure gas at a compressor 12 and then supplied via a four way valve 22 to an out-room heat exchanger 13 where the refrigerant gas is condensed to become a high-temperature/high-pressure liquid. Subsequently, the high-temperature/high-pressure liquid is throttled at an expansion valve 14 so as to be a low-temperature/low pressure liquid which is then vaporized at an in-room heat exchanger 15 to become a low-pressure superheated steam and returned to the compressor 12 via the four way valve 22. On the other hand, in case of a heating operation of the heat pump, the refrigerant flow is substantially reversed as shown by blank arrows in the figure.

Figure 1:
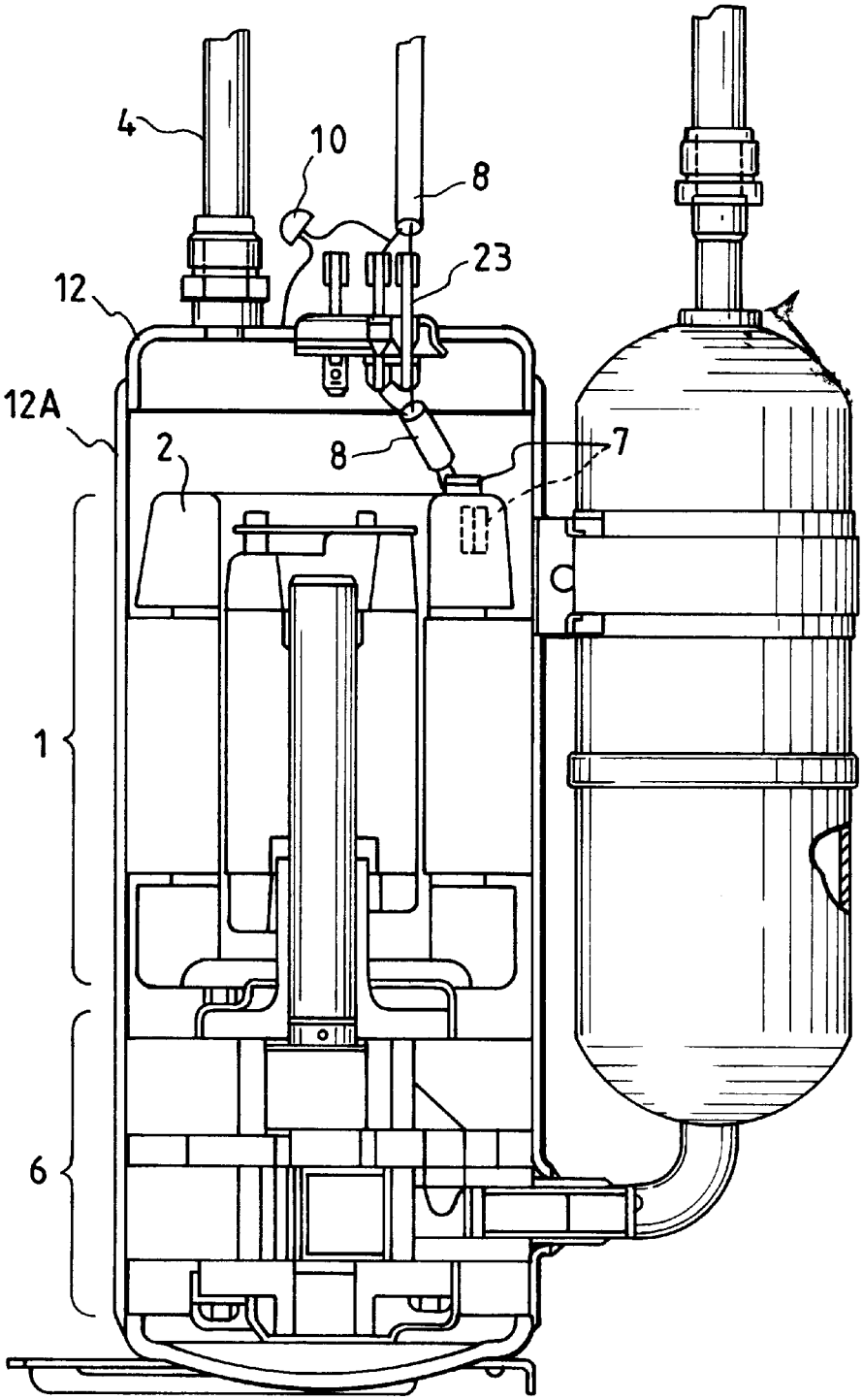
FIG. 1 is a schematic sectional view of a hermetic electric compressor according to a first preferred embodiment of the present invention.

FIG. 1 shows a hermetic electric compressor for a car air conditioner according to a first preferred embodiment of the present invention.

Figure 3:
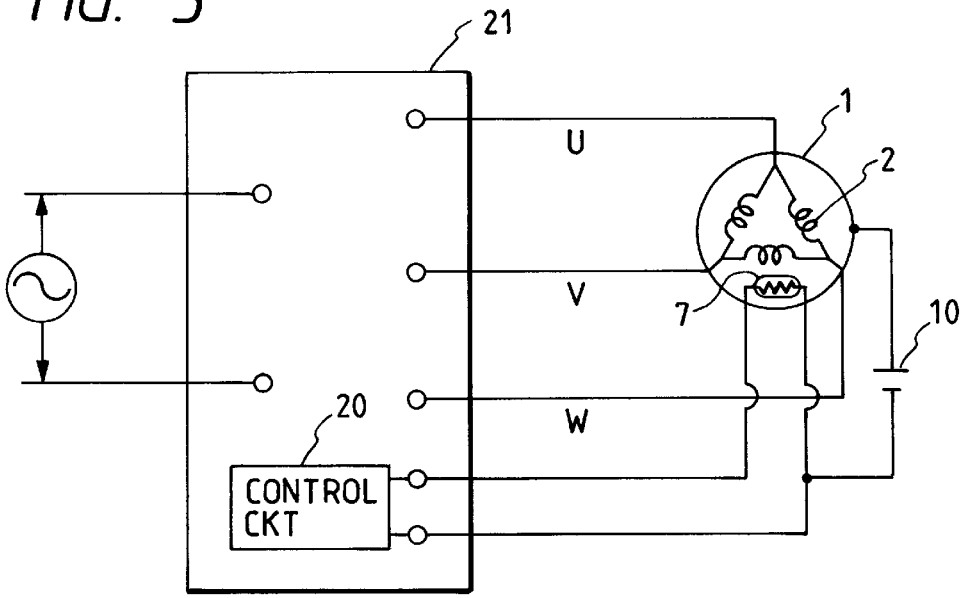
FIG. 3 is a diagram schematically showing an electric circuit of the compressor according to each of the first and second preferred embodiments.

In FIG. 1, the compressor 12 includes a sealed casing 12A. The sealed, casing 12A includes therein a three-phase motor unit 1, and a compressor unit 6 driven by the motor unit 1 for compressing refrigerant gas. The compressor 12 further includes a discharge pipe 4 for discharging the compressed refrigerant gas outside the sealed casing 12A for the refrigerating cycle. As shown in FIG. 3, the motor unit 1 includes a stator having a coil unit 2 with three coils. The three coils are connected to an inverter unit 21 via three-phase terminals U, V and W, respectively, for receiving alternating current of a controlled frequency. A temperature sensor 7 in the form of a thermistor is firmly tied at a proper portion on the coil unit 2 or between the coils, using proper strings for this purpose, and is connected to a control circuit 20 of the inverter unit 21.

In this preferred embodiment, the temperature sensor 7 and the control circuit 20 are connected via a shielded cable 8. Specifically, as shown in FIG. 1, the temperature sensor 7 and inner terminals, located inside the sealed casing 12A, of a connector 23 are connected via the shielded cable 8, and outer terminals, located outside the sealed casing 12A, of the connector 23 and the control circuit 20 are connected via the shielded cable 8. It is possible that at least one of those portions, that is, between the temperature sensor 7 and the inner terminals and between the outer terminals and the control circuit 20, may be connected via the shielded cable 8.

Figure 10:
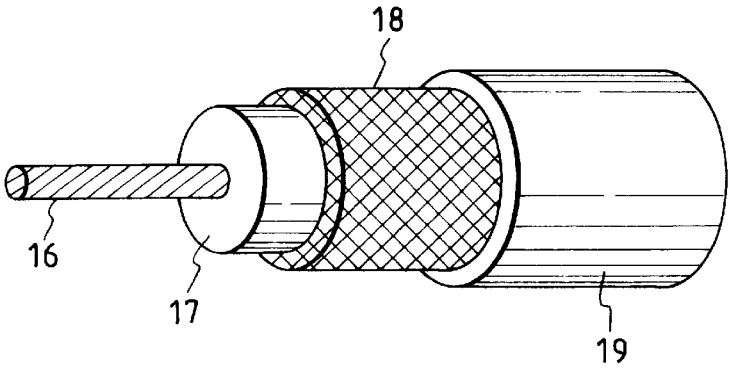
FIG. 10 is a diagram showing a structure of a shielded cable.

As shown in FIG. 10, the shielded cable 8 includes, as is well known, a center conductor 16, an insulator 17, a shield conductor (grounded) 18 and a jacket 19 in the order named from the center of the cable 8.

In this preferred embodiment, as shown in FIGS. 1 and 3, the shield conductor 18 is grounded to the sealed casing 12A via a capacitor 10 at a portion other than the connector 23.

An operation of the compressor 12 having the foregoing structure will be described hereinbelow.

When a temperature of the coil unit 2, as monitored by the temperature sensor 7, exceeds a first preset value, the control circuit 20 detects it and lowers a frequency of the alternating current fed to the coil unit 2, that is, a rotational frequency or speed of the motor unit 1 or an operation frequency of the compressor 12, to a preset value so as to reduce the load of the compressor 12. Further, if the temperature of the coil unit 2, as monitored by the temperature sensor 7, exceeds a second preset value which is set slightly greater than the first preset value, the control circuit 20 detects it and stops energization to the coil unit 2 so that the compressor 12 is stopped in operation. With this two-step control, damage of the coil unit 2 due to heat is reliably prevented. Further, since the temperature sensor 7 is provided at the coil unit 2, the temperature of the coil unit 2 can be monitored precisely as compared with the foregoing conventional compressor where then thermistor 5 is provided at the discharge pipe 4. Moreover, since the compressor continues to be operated until the temperature of the coil unit 2 exceeds the second value after lowering the rotational frequency or speed of the motor unit 19 the continued operation of the compressor 12 is ensured as compared with the foregoing conventional compressor where the thermostat 3 is used.

Further, since the shielded cable 8 is used to connect the temperature sensor 7 and the control circuit 20, the operation of the control circuit 20, which monitors a small voltage variation from the temperature sensor 7, is protected from electrical noise caused by the operation of the inverter unit 21 or the like. This is further enhanced by grounding the shield conductor 18 of the shielded cable 8 via the capacitor 10.

In this preferred embodiment, the thermistor is used as the temperature sensor 7. On the other hand, instead of the thermistor, a thermoelectric thermometer or a pressure gauge type thermometer may be used therefor.

Figure 2:
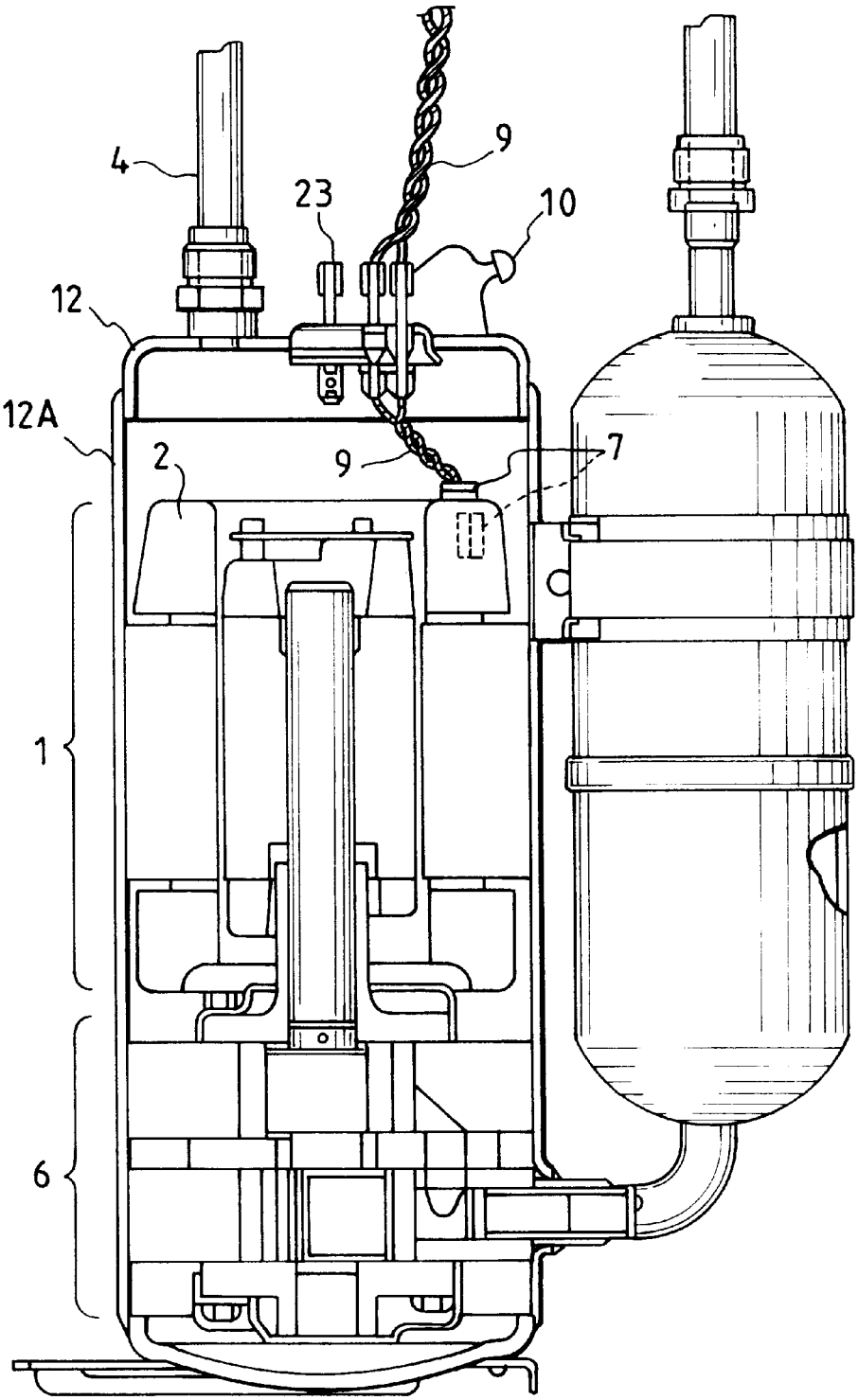
FIG. 2 is a schematic sectional view of a hermetic electric compressor according to a second preferred embodiment of the present invention.

FIG. 2 shows a hermetic electric compressor for a car air conditioner according to a second preferred embodiment of the present invention. The second preferred embodiment differs from the first preferred embodiment only in that a twisted pair 9 is used instead of the shielded cable 8. As shown in FIG. 2, one line of the twisted pair 9 is grounded to the sealed casing 12A via a capacitor 10 at a portion other than the connector 23. The other structure is the same as that in the first preferred embodiment.

With the foregoing arrangement, the second preferred embodiment can also achieve effects similar to those in the first preferred embodiment.

Figure 5:
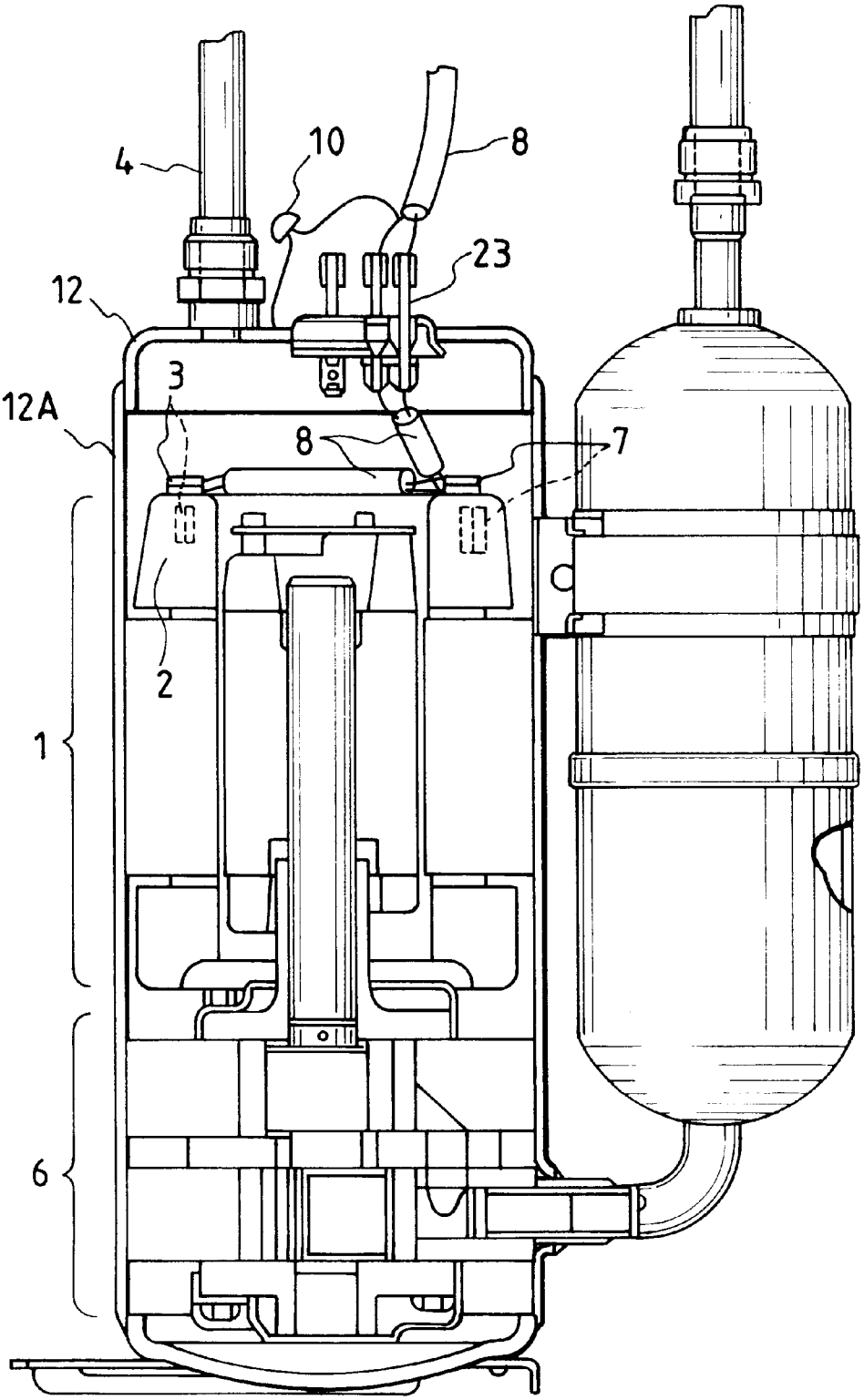
FIG. 5 is a schematic sectional view of a hermetic electric compressor according to a third preferred embodiment of the present invention.

FIG. 5 shows a hermetic electric compressor for a car air conditioner according to a third preferred embodiment of the present invention.

Figure 7:
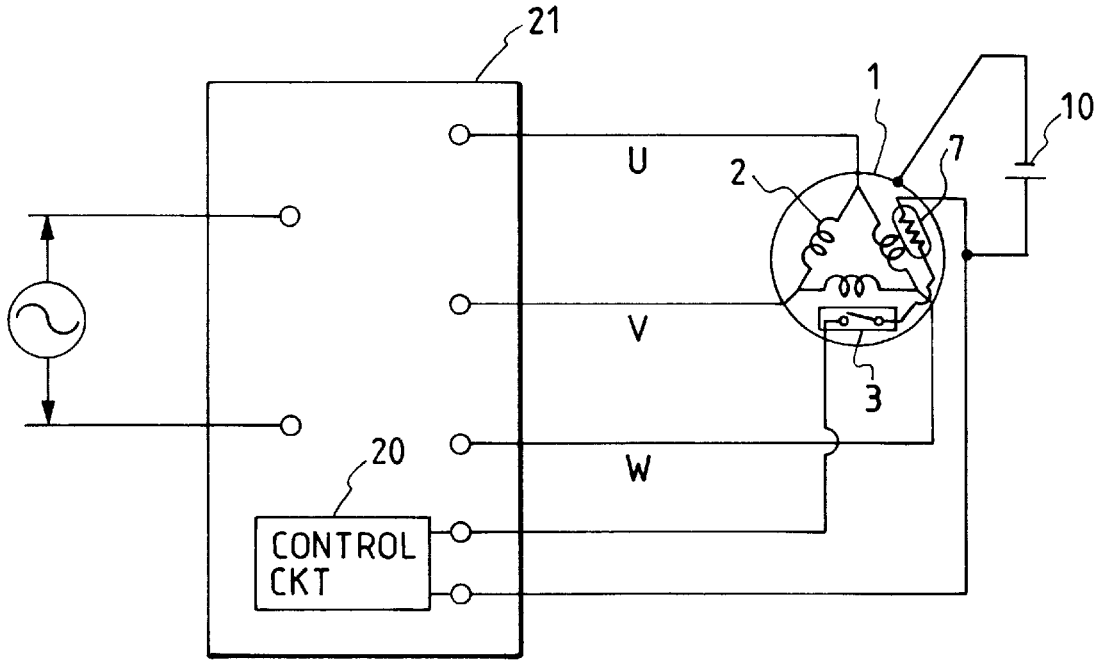
FIG. 7 is a diagram schematically showing an electric circuit of the compressor according to each of the third and fourth preferred embodiments.
Figure 8:
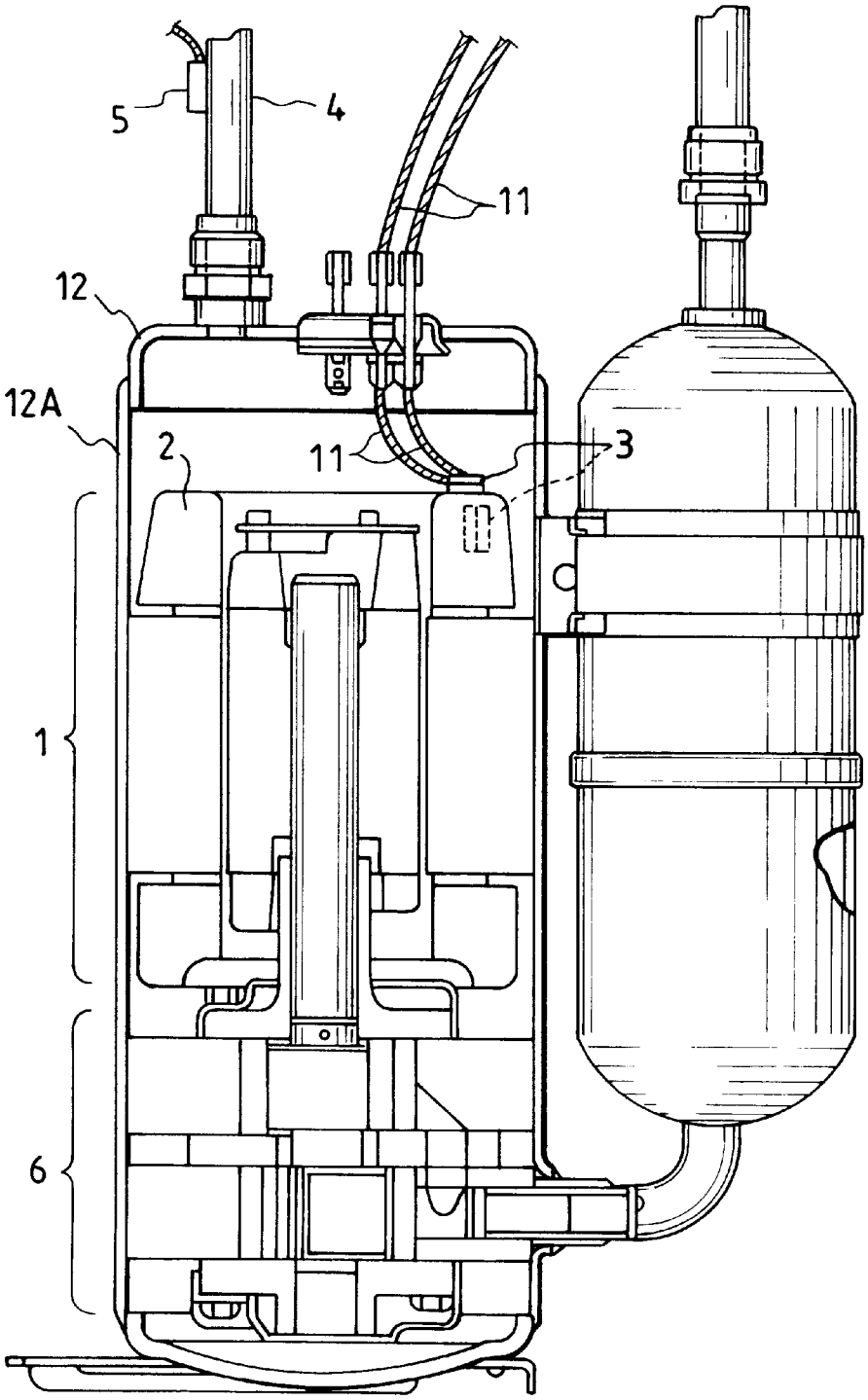
FIG. 8 PRIOR ART
FIG. 8 is a schematic sectional view of a conventional hermetic electric compressor.
Figure 9:
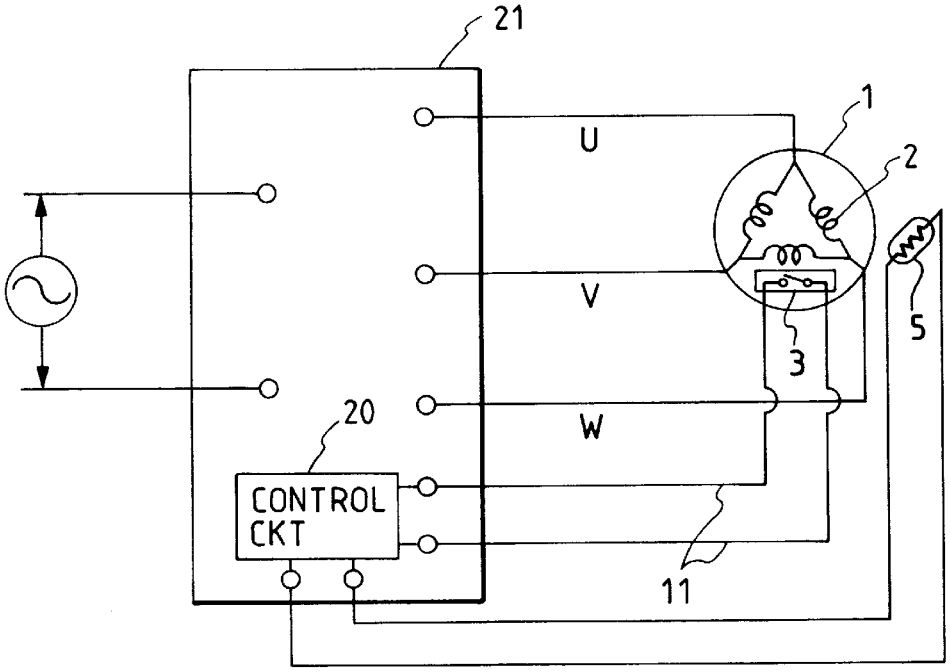
FIG. 9 PRIOR ART
FIG. 9 is a diagram schematically showing an electric circuit of the conventional compressor shown in FIG. 8.

As shown in FIG. 5, a thermostat 3 is further provided at the coil unit 2 in the same manner as the temperature sensor 7 using the proper strings. The thermostat 3 and the temperature sensor 7 are connected in series to each other as shown in FIG. 7, and via a shielded cable 8 as shown in FIG. 5. The other structure is the same as that in the foregoing first preferred embodiment.

With this arrangement, when a temperature of the coil unit 2, as monitored by the temperature sensor 7, exceeds a first preset value, the control circuit 20 detects it and lowers a frequency of the alternating current fed to the coil unit 2, that is, a rotational frequency or speed of the motor unit 1 or an operation frequency of the compressor 12, to a preset value so as to reduce the load of the compressor 12. Further, if the temperature of the coil unit 2 exceeds a second preset value which is set slightly greater than the first preset value, the thermostat 3 is operated to open the circuit. The control circuit 20 detects it and stops energization to the coil unit 2 so that the compressor 12 is stopped in operation.

As appreciated, the third preferred embodiment can also achieve effects similar to those in the first preferred embodiment.

Figure 6:
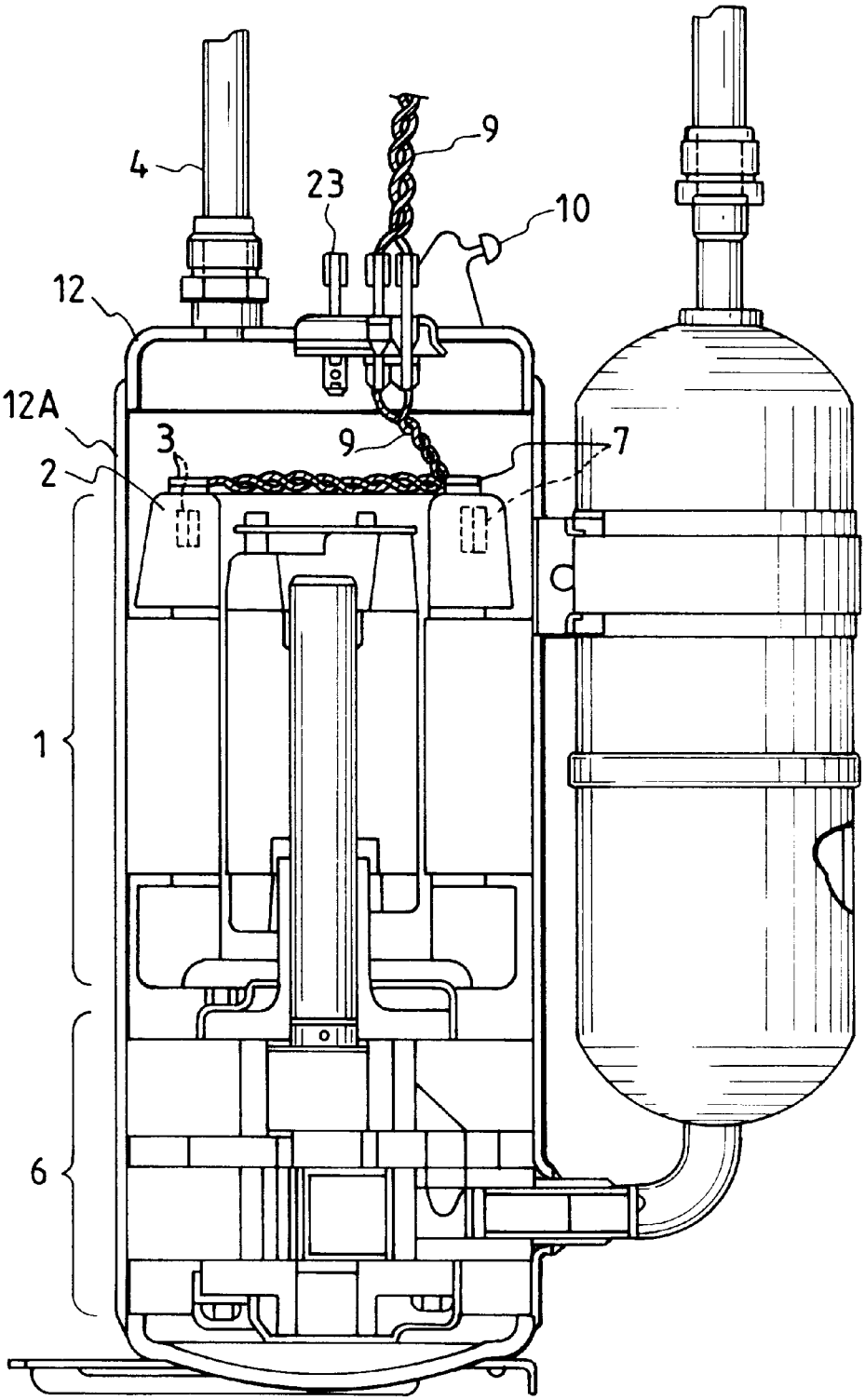
FIG. 6 is a schematic sectional view of a hermetic electric compressor according to a fourth preferred embodiment of the present invention.

FIG. 6 shows a hermetic electric compressor for a car air conditioner according to a fourth preferred embodiment of the present invention. The fourth preferred embodiment differs from the third preferred embodiment only in that a twisted pair 9 is used instead of the shielded cable 8. As shown in FIG. 6, one line of the twisted pair 9 is grounded to the sealed casing 12A via a capacitor 10. The other structure is the same as that in the third preferred embodiment.

With the foregoing arrangement, the fourth preferred embodiment can also achieve effects similar to those in the third preferred embodiment.

While the present invention has been described in terms of the preferred embodiments, the invention is not to be limited thereto, but can be embodied in various ways without departing from the principle of the invention as defined in the appended claims.

What is claimed is:

1. A hermetic electric compressor comprising:

a sealed casing;

a motor unit provided in said sealed casing and having a stator coil;

a compressor unit provided in said sealed casing and driven by said motor unit for compressing a refrigerant;

a thermistor provided at said stator coil for monitoring a temperature of said stator coil; and control means, responsive to said temperature monitored by said temperature sensor, for controlling a speed of said motor unit via said stator coil, wherein said temperature sensor and said control means are connected via a shielded cable at least partly, and wherein said control means drops the speed of said motor unit to a preset value when the temperature monitored by said temperature sensor exceeds a first preset value and wherein said control means stops said motor unit when the temperature monitored by said temperature sensor exceeds a second preset value which is greater than said first preset value.

2. The hermetic electric compressor according to claim 1, wherein a shield conductor of said shielded cable is grounded to said sealed casing via a capacitor.

3. The hermetic electric compressor according to claim 1, wherein a connector is further provided at said sealed casing so as to have inner terminals located inside said sealed casing and outer terminals located outside said sealed casing, wherein said temperature thermistor is connected to said inner terminals and said control means is connected to said outer terminals, and wherein said thermistor and said inner terminals are connected via the shielded cable.

4. The hermetic electric compressor according to claim 1, wherein a connector is further provided at said sealed casing so as to have inner terminals located inside said sealed casing and outer terminals located outside said sealed casing, wherein said thermistor is connected to said inner terminals and said control means is connected to said outer terminals, and wherein said control means and said outer terminals are connected via the shielded cable.

5. The hermetic electric compressor according to claim 4, wherein a shield conductor of said shielded cable is grounded to said sealed casing at a portion other than said connector.

6. The hermetic electric compressor according to claim 5, wherein the shield conductor of said shielded cable is grounded to said sealed casing via a capacitor.

7. A hermetic electric compressor comprising:

a sealed casing;

a motor unit provided in said sealed casing and having a stator coil;

a compressor unit provided in said sealed casing and driven by said motor unit for compressing a refrigerant;

a thermistor provided at said stator coil for monitoring a temperature of said stator coil; and control means, responsive to said temperature monitored by said temperature sensor, for controlling a speed of said motor unit via said stator coil, wherein said temperature sensor and said control means are connected via a twisted pair at least partly, and wherein said control means drops the speed of said motor unit to a preset value when the temperature monitored by said temperature sensor exceeds a first preset value and wherein said control means stops said motor unit when the temperature monitored by said temperature sensor exceeds a second preset value which is greater than said first preset value.

8. The hermetic electric compressor according to claim 7, wherein one line of said twisted pair is grounded to said sealed casing via a capacitor.

9. The hermetic electric compressor according to claim 7, wherein a connector is further provided at said sealed casing so as to have inner terminals located inside said sealed casing and outer terminals located outside said sealed casing, wherein said thermistor is connected to said inner terminals and said control means is connected to said outer terminals, and wherein said thermistor and said inner terminals are connected via the twisted pair.

10. The hermetic electric compressor according to claim 7, wherein a connector is further provided at said sealed casing so as to have inner terminals located inside said sealed casing and outer terminals located outside said sealed casing, wherein said thermistor is connected to said inner terminals and said control means is connected to said outer terminals, and wherein said control means and said outer terminals are connected via the twisted pair.

11. The hermetic electric compressor according to claim 10, wherein one line of said twisted pair is grounded to said sealed casing at a portion other than said connector.

12. The hermetic electric compressor according to claim 11, wherein said one line of the twisted pair is, grounded to said sealed casing via a capacitor.

13. A hermetic electric compressor comprising:

a sealed casing;

a motor unit provided in said sealed casing and having a stator coil;

a compressor unit provided in said sealed casing and driven by said motor unit for compressing a refrigerant;

a thermistor provided at said stator coil for monitoring a temperature of said stator coil;

control means, responsive to said temperature monitored by said thermistor, for controlling a speed of said motor unit via said stator coil, and wherein said control means drops the speed of said motor unit to a preset value when the temperature monitored by said thermistor exceeds a first preset value and wherein said control means stops said motor unit when the temperature monitored by said thermistor exceeds a second preset value which is greater than said first preset value.

* * * * *